United States Patent [19]

Wakefield et al.

[11] Patent Number: 4,517,049

[45] Date of Patent: May 14, 1985

[54] SILICON RIBBON GROWTH WHEEL WITH EDGE DEFINING GROOVES

[75] Inventors: G. Felix Wakefield, Woodland Hills; David L. Bender; Samuel N. Rea, both of Thousand Oaks, all of Calif.

[73] Assignee: Atlantic Richfield Company, Los Angeles, Calif.

[21] Appl. No.: 391,095

[22] Filed: Jun. 23, 1982

[51] Int. Cl.[3] ..... B30B 19/12

[52] U.S. Cl. ..... 156/622; 422/246; 422/254; 136/261

[58] Field of Search ..... 156/622, 624, DIG. 88; 422/246, 253, 254; 164/122.2, 423, 463, 166; 425/223, 224; 136/261

[56] References Cited

U.S. PATENT DOCUMENTS

| | | | |
|---|---|---|---|
| 3,605,863 | 9/1971 | King | 164/463 |
| 3,881,542 | 5/1975 | Polk et al. | 164/463 |
| 4,408,653 | 10/1983 | Nienart et al. | 164/463 |

*Primary Examiner*—Hiram H. Bernstein
*Attorney, Agent, or Firm*—Albert C. Metrailer

[57] ABSTRACT

Apparatus and method for producing semiconductor ribbon directly from the molten state by contact with a moving chill surface wherein the chill surface has longitudinal grooves near its outer edges to define ribbon width and improve smoothness of ribbon edges.

11 Claims, 2 Drawing Figures

SILICON RIBBON GROWTH WHEEL WITH EDGE DEFINING GROOVES

BACKGROUND OF THE INVENTION

The present invention relates to methods and apparatus for the production of semiconductor ribbons from a melt and more particularly to improved apparatus and methods in which ribbon edges are controlled and defined by grooves in a moving chill surface.

A reference known to the Applicants and believed to be relevant to the present invention is U.S. Pat. No. 3,605,863 issued to King on Sept. 20, 1971. This patent is hereby incorporated by reference for its general teachings of apparatus and methods for formation of ribbon materials which are generally applicable to formation of semiconductor ribbons.

It is generally recognized that a major portion of the cost of production of solar cells is the cost of the original high purity silicon and its preparation into wafers of suitable size and shape. A standard process involves the growing of monocrystalline boules using the Czochralski technique and then mechanically sawing the boules into thin slices or wafers. Half of the original silicon material is typically lost in the sawing process. Photovoltaic cells have also been made from polycrystalline silicon after it was poured into essentially brick-shaped molds and then sawed into square slices. While such processing of polycrystalline material is less expensive than growth of single crystal material, the resulting cells have lower efficiency and essentially half of the material is still lost in the sawing process. Much effort has, therefore, been made to develop apparatus and techniques for producing wafers or ribbons of silicon directly from the molten state. The above-referenced King patent illustrates one type of apparatus which has resulted from such efforts.

The basic method illustrated by the King patent includes the contacting of a molten body of material with the surface of a moving drum or wheel. The surface of the wheel is cool relative to the molten mass and by cooling a portion thereof, pulls or drags off a film or ribbon of the material in a solidified form. In using this method, it is important to provide a careful balance between the molten material flow to the wheel and wheel speed. If too little material is provided to the surface, full width ribbon will not be formed. It is, therefore, generally considered preferable to run in a slightly flooded condition which means that occasionally molten material will spill over the edge of the wheel. Whenever one of these spills occurs, surface tension effects cause the errant material to drag off a sizeable volume of ribbon which results in a rough jagged ribbon edge. The rough edges must be trimmed to provide uniform width ribbon for subsequent processing. In addition, edge rounding may be required to reduce edge chips and cracks which can cause breakage during later processing. The additional machining and smoothing steps are undesirable since they add to the cost of processing the semiconductor material into wafers or slices.

SUMMARY OF THE INVENTION

Accordingly, an object of the present invention is to provide improved apparatus for producing semiconductor ribbon materials.

Another object of the present invention is to provide equipment for manufacturing semiconductor ribbon material having uniform edge width and smoothness.

Another object of the present invention is to provide methods for producing semiconductor ribbon materials of uniform width and improved edge smoothness.

Apparatus according to the present invention includes means for contacting a molten mass of semiconductor material with a moving chill surface where said surface is provided with a pair of longitudinal grooves defining finished ribbon width. In a preferred method of practicing the present invention, a slight excess of semiconductor material is provided to the chill surface with the excess material forming separate filaments or ribbons outboard of at least one of the longitudinal grooves.

BRIEF DESCRIPTION OF THE DRAWINGS

The present invention may be better understood by reading the following detailed description of the preferred embodiments with reference to the accompanying drawings wherein.

DESCRIPTION OF THE PREFERRED EMBODIMENTS

Figure 1:
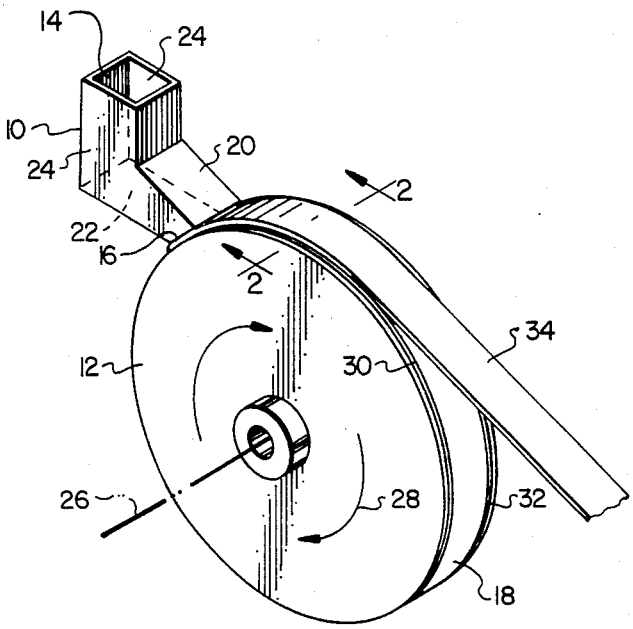
FIG. 1 is a perspective view of the basic components of a ribbon production apparatus according to the present invention.

With reference now to FIG. 1 there is illustrated the basic components of a ribbon producing apparatus according to the present invention. The basic elements comprise a tundish 10 and a rotating wheel 12. Tundish 10 comprises a number of flat quartz plates assembled to form an enclosure having an inlet 14 for receiving molten semiconductor material and an outlet 16 adjacent the outer surface 18 of wheel 12. Opening 16 has the shape of a narrow rectangular slot formed between upper and lower plates 20 and 22 and a pair of side plates 24. The inner edges of side plates 24 are spaced apart by a distance corresponding to the width of surface 18 of wheel 12, which in the preferred embodiment is nominally two inches. Wheel 12 is provided with means for rotating about axis 26 in the direction indicated by arrow 28 and is provided with cooling means such as that illustrated in the above-referenced King patent.

In the preferred embodiment, a pair of longitudinal grooves 30 and 32 are machined into the outer surface 18 of wheel 12. As will be explained in more detail below, the grooves 30 and 32 control the width of ribbon 34 formed on wheel 12. Although not illustrated in FIG. 1, the ribbon forming system is generally operated in a closed chamber having a controlled atmosphere and means are provided for collecting ribbon 34 as it is formed on wheel 12.

Figure 2:
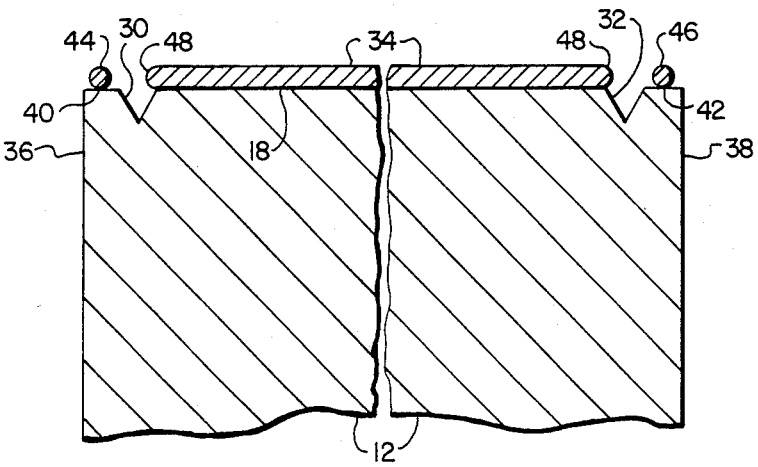
FIG. 2 is a cross-sectional illustration of the wheel or drum of FIG. 1 illustrating the edge defining groove structure according to the present invention.

With reference now to FIG. 2, there is provided a cross-sectional illustration of the outer edge 18 of wheel 12 at the top portion thereof as indicated in FIG. 1. As illustrated in FIG. 2, the grooves 30 and 32 preferably have a V-shaped cross section. In this embodiment, the grooves are approximately 1/32 inch deep and from 1/32 to 1/16 inch wide. The grooves 30 and 32 are positioned about 1/16 inch inboard of the outer edges 36 and 38 respectively of wheel 12. This positioning of grooves 30 and 32 leaves narrow strips 40 and 42 of the outer wheel surface 18 isolated from the main portion thereof. As will be discussed in more detail below, the strips 40 and 42 act to collect excess material as illustrated by the strips or strings 44 and 46.

In the preferred embodiment, as in the above referenced King patent, a rotating wheel or drum is used as a moving chill surface with which molten material is contacted for cooling to the solid state. The present invention should also be applicable to other types of moving chill surfaces. For example, other ribbon forming apparatus has used a continuous metal belt or band carried on two or more rollers or drums as a moving chill surface.

In operation, the wheel 12 is rotated while molten semiconductor material is poured into opening 14 of tundish 10. The rates of wheel rotation and material flow are ideally adjusted so that the input of molten material exactly equals the volume of ribbon 34 produced. As noted above, such precise adjustment is difficult. If material is provided to tundish 10 at too low of a rate, the ribbon 34 does not flow to the full width of wheel 12. If material is supplied at too high of a rate, the excess material tends to flow over the sides of wheel 12 causing the rough edge problems discussed above. The grooved wheel of the present invention allows material in excess of that needed to produce ribbon 34 to be collected in the form of strings 44 and 46 on the narrow wheel surfaces 40 and 42. If the flow rate is adjusted ideally, that is exactly enough input material is provided to produce ribbon 34, neither of the filaments 44 or 46 are produced. Instead, the ribbon 34 is formed out to the inner edges of grooves 30 and 32 and has rounded edges 48 formed by the surface tension of the semiconductor material. As the input flow exceeds the ideal amount, ribbon 34 extends out over groove 30 and/or groove 32 to contact edge surfaces 40 or 42. As contact with the outer edge surfaces 40 and 42 is made, the lack of support caused by grooves 30 and 32 and surface tension effects of the silicon causes formation of the filaments 44 and 46 which separate from the main body of ribbon 34 leaving the rounded edges 48. Since the excess material, if any, does not fall away from the edges of the main body of the ribbon, the rough edges previously encountered are avoided.

In some experimental runs, excess silicon formed a ribbon or filament within one or both grooves 30 and 32. This usually occurred when the groove width exceeded the nominal dimensions. Even in these cases, the excess material was mostly or totally separated from the ribbon 34.

In all experimental ribbon production runs, the wheel 12 had a diameter of 31 inches and a width of 2 inches. Most experiments were performed with a wheel having a stainless steel surface 18 although good results were achieved with both copper and brass surfaces. In a typical run, 10 kgm of virgin silicon doped with 34 gms of boron was melted at a temperature of 1540° C. Tundish 10 was maintained at a temperature of 1550° C. by means of electrical heaters built into and around the tundish. The speed of wheel 12 was varied between 3.2 and 6.1 rpm while silicon was poured into tundish 10 at an average rate of 356 gms per minute during a period of 28.06 minutes. The wheel had two grooves, i.e. one near each edge, as described above. The ribbon produced in this run had a thickness from 0.010 inch to 0.020 inch and good to excellent edge definition and quality.

While the present invention has been illustrated and described with respect to particular apparatus and methods of operation, it is understood that various modifications and changes can be made therein within the scope of the invention as defined by the appended claims.

We claim:

1. In apparatus for production of semiconductor ribbon in which molten semiconductor material is brought into contact with a moving chill surface, the improvement comprising:

a chill surface having a pair of longitudinal grooves, said grooves spaced apart by a desired ribbon width.

2. Improved apparatus according to claim 1 wherein said grooves have a V-shaped cross section.

3. Improved apparatus according to claim 2 wherein said V-shaped grooves are about 1/32 inch deep and from about 1/32 inch to 1/16 inch wide.

4. Apparatus according to claim 1 wherein said chill surface is the outer surface of a wheel.

5. Apparatus according to claim 1 wherein each of said grooves is positioned near an edge of said chill surface.

6. A method for providing well defined edges in semiconductor ribbon formed by contacting molten semiconductor material with the surface of a moving chill surface comprising:

providing a pair of longitudinal grooves along opposite edges of said chill surface, said grooves spaced apart by a preselected ribbon width.

7. A method according to claim 6 wherein said grooves have a V-shaped cross section.

8. A method according to claim 6 wherein said grooves are about 1/32 inch deep and have a maximum width of from about 1/32 inch to about 1/16 inch.

9. A method according to claim 6 wherein said chill surface is the outer surface of a wheel.

10. A method according to claim 6 wherein each of said grooves is positioned near an edge of said chill surface.

11. A method of producing semiconductor ribbon material comprising:

contacting a body of molten semiconductor material with the surface of a cool rotating wheel, said wheel having a pair of longitudinal grooves in its surface spaced apart by a desired ribbon width.

* * * * *